US007224255B2

(12) United States Patent
Uehara et al.

(10) Patent No.: US 7,224,255 B2
(45) Date of Patent: May 29, 2007

(54) OVERHEAT PROTECTION DEVICE FOR MOVABLE BODY SURFACE, OVERHEAT PROTECTION APPARATUS USING THE SAME AND TEMPERATURE CONTROL DEVICE

(75) Inventors: Yasuhiro Uehara, Nakai-machi (JP); Kazuyoshi Itoh, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 323 days.

(21) Appl. No.: 10/921,856

(22) Filed: Aug. 20, 2004

(65) Prior Publication Data

US 2005/0140491 A1 Jun. 30, 2005

(30) Foreign Application Priority Data

Dec. 26, 2003 (JP) ..... 2003-435692

(51) Int. Cl.
*H01H 85/143* (2006.01)
*H01H 85/147* (2006.01)

(52) U.S. Cl. ..... 337/297; 337/401

(58) Field of Classification Search ..... 337/297, 337/401

See application file for complete search history.

(56) References Cited

U.S. PATENT DOCUMENTS 1,086,909 A * 2/1914 Fisher ..... 337/237
4,635,010 A * 1/1987 Miyai et al. ..... 399/108
4,745,431 A * 5/1988 Kogure et al. ..... 399/69
5,435,882 A * 7/1995 Azamar et al. ..... 156/359
5,592,278 A * 1/1997 Sato et al. ..... 399/384
2005/0081978 A1* 4/2005 Britz ..... 156/64

FOREIGN PATENT DOCUMENTS

JP 3-144685 6/1991
JP 9-7481 1/1997
JP 10010919 A * 1/1998
JP 2001-334394 12/2001

* cited by examiner

*Primary Examiner*—Anatoly Vortman
(74) *Attorney, Agent, or Firm*—Morgan, Lewis & Bockius LLP

(57) ABSTRACT

An overheat protection device for a movable body surface includes a thermal fuse having a fuse element which melts at a predetermined temperature, bridges electrodes in a pair and melts at a temperature equal to or higher than the predetermined temperature to break an electrical connection between the pair of electrodes, and a pair of long elastic bodies, to each of which one of the electrodes is electrically connected at an end or its periphery of the elastic body through a lead. At least one of pairs of upper surfaces and lower surfaces of the elastic bodies are spatially on a same plane.

22 Claims, 9 Drawing Sheets

OVERHEAT PROTECTION DEVICE FOR MOVABLE BODY SURFACE, OVERHEAT PROTECTION APPARATUS USING THE SAME AND TEMPERATURE CONTROL DEVICE

BACKGROUND OF THE INVENTION

1. Field of the Invention

The present invention relates to an overheat protection device used for prevention of overheating of the surface of a movable body, which is heated by a heating device while temperature control is performed on the surface, an overheat protection apparatus, and a temperature control device having a function as a temperature detection device for temperature control in addition to a function of such overheat protection.

2. Description of the Related Art

Conventionally, some electronic devices, electric heaters, heat exchangers and the like (e.g., water heaters and air heating apparatuses) detect the temperature in a predetermined position with a temperature sensor for temperature control. These devices are provided with a temperature control unit to stop energization or combustion when the detected temperature has exceeded a target temperature. However, there is a possibility that such temperature control unit operates abnormally due to a trouble or break in circuit parts of an internal control circuit. Accordingly, a protection device for overheating (overheat protection device) is previously provided in a position to avoid abnormal overheating in addition to the above-described temperature control unit. As a safety measure, when the protection device is activated, a break is caused in a power circuit of the heating device, thereby a serious accident can be prevented.

As such a protection device, a resettable device such as a bimetal switch and an unresettable type thermal fuse using a thermo-sensitive pellet (sensor) of insulating chemical material or fusible alloy which melts at a particular temperature are known. Among the latter devices, generally, a thermal fuse using fusible alloy has a simple structure, and is a low-cost and low-price device.

FIG. 17 is a plan view showing an example of a thermal fuse (hereinbelow, also referred to as a "fusible alloy thermal fuse") using a fusible alloy. FIG. 18 is a cross-sectional view along a line K—K in FIG. 17. Note that in FIG. 17, some members are cut, and portions that would exist if not cut, or portions hidden with cut parts are indicated with dot and broken lines.

In FIG. 17 and FIG. 18, reference numeral 110 denotes a rectangular insulating substrate of ceramic material such as alumina. A pair of electrodes 104*a* and 104*b*, of calcined Ag conductive paste such as Ag paste, AgPd paste or AgPt paste, are formed at both ends of the insulating substrate 110. A fuse element 102 of a fusible alloy which melts in response to ambient temperature is connected, by welding and the like, between the pair of electrodes 104*a* and 104*b*, in a state where it bridges the both electrodes, integrally with these electrodes. The surface of the fuse element 102 is covered with flux 106, and the entire flux 106 is covered with an insulating cap 108 of mold member of alumina ceramic or resin, and further, the perimeter of the cap is fix-sealed with seal resin and the like. In accordance with necessity, leads are connected by soldering and the like to the pair of electrodes 104*a* and 104*b*, and the fuse is provided as a thermal fuse.

FIG. 19 is a longitudinal cross-sectional view showing an example of a so-called axial type (cylindrical) fusible alloy thermal fuse. In the fusible alloy thermal fuse, a pair of leads 114*a* and 114*b* with round ends and cross section are provided such that the ends having an electrode function are opposed to each other. The opposed ends of the pair of leads 114*a* and 114*b* are fixed by welding and the like to both ends of a fuse element 112 of a low-fusion point alloy having round ends and cross section, and covered with flux 116. Further, the fuse is inserted into a cylindrical insulating case 120 of alumina ceramic and the like, and openings at both ends of the insulating case 120 are sealed with insulating seal material 118 of epoxy resin and the like.

In the fusible alloy thermal fuse, when the temperature of the thermal fuse itself has exceeded a predetermined temperature as an abnormal temperature in response to thermal conduction, a convection current and radiation from a subject of detection, the fuse element 102 or 112 of fusible alloy melts then the opposed ends of the pair of electrodes 104*a* and 104*b* or the leads 114*a* and 114*b* are electrically isolated, thus a break is caused in a power circuit of a heating device, thereby a serious accident can be prevented.

However, in a case where the temperature of the subject of detection rapidly rises, the temperature of the thermal fuse is greatly different from that of the subject of detection. In such a case, an influence on a user and peripheral devices can be prevented, but there is a possibility that the function of thermally protecting the subject of detection and ensuring sufficient safety cannot be performed. Further, in a case where the subject of detection is a movable body such as a rotary member, since it is generally impossible to bring the thermal fuse into direct contact with the subject of detection, the thermal fuse is provided with an interval from the subject of detection. In this case, there is no thermal conduction from the subject of detection and the thermal response of the thermal fuse is not excellent. Accordingly, in some cases, when the thermal fuse is actuated, the temperature of the subject of detection has already reached a temperature to cause thermal damage.

A particular example is a rotary heating body (heating roller, a heating belt and the like) of a fixing apparatus incorporated in an electrophotographic apparatus such as a copier or a printer. In such a fixing apparatus, an unfixed toner image is heated and pressurized by the rotary heating body of the fixing apparatus, thereby toner is fuse-fixed. In recent years, in the electrophotographic apparatus, further reduction of heating time (warm-up time) between switch-on and fixing-possible time (improvement in instant startablity) is needed. For this purpose, there is a trend of heating upon start with higher heating energy in comparison with the thermal capacity of the rotary heating body. In such a case, the problem is noticeable in the response of the thermal fuse when the temperature of the rotary heating body as a subject of detection is greatly different from that of the thermal fuse.

SUMMARY OF THE INVENTION

The present invention has been made in consideration of the above situation, and provides an overheat protection device which has a high response to a temperature change even if the temperature of a movable body as a subject of detection rises radically, and which prevents a general accident due to abnormal temperature rise and prevents thermal damage to the movable body itself by reducing the difference between the temperature of itself and that of the surface of the movable body as much as possible under abnormal conditions. An overheat protection apparatus using the overheat protection device is also provided.

Further, the subject of detection, where the overheat protection device is employed, is generally provided with a heating device with temperature control, and with a temperature detection device to detect the temperature of the subject of detection in a real time manner upon temperature control. Accordingly, the present invention provides a temperature control device which has a function as a temperature detection device for the temperature control in addition to the above-described function of overheat protection.

According to an aspect of the present invention, an overheat protection device for a movable body surface includes a thermal fuse having a fuse element which melts at a predetermined temperature, bridges electrodes in a pair and melts at a temperature equal to or higher than the predetermined temperature to break an electrical connection between the pair of electrodes, and a pair of long elastic bodies, to each of which one of the electrodes is electrically connected at an end or its periphery of the elastic body through a lead. At least one of pairs of upper surfaces and lower surfaces of the elastic bodies are spatially on a same plane.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE INVENTION

Embodiments of the present invention will now be described in detail in accordance with the accompanying drawings.

<First Embodiment>

Hereinbelow, a first embodiment as an example of an overheat protection device according to the present invention will be described. In the overheat protection device of the embodiment, a thermal fuse of substrate type is employed.

Figure 1:
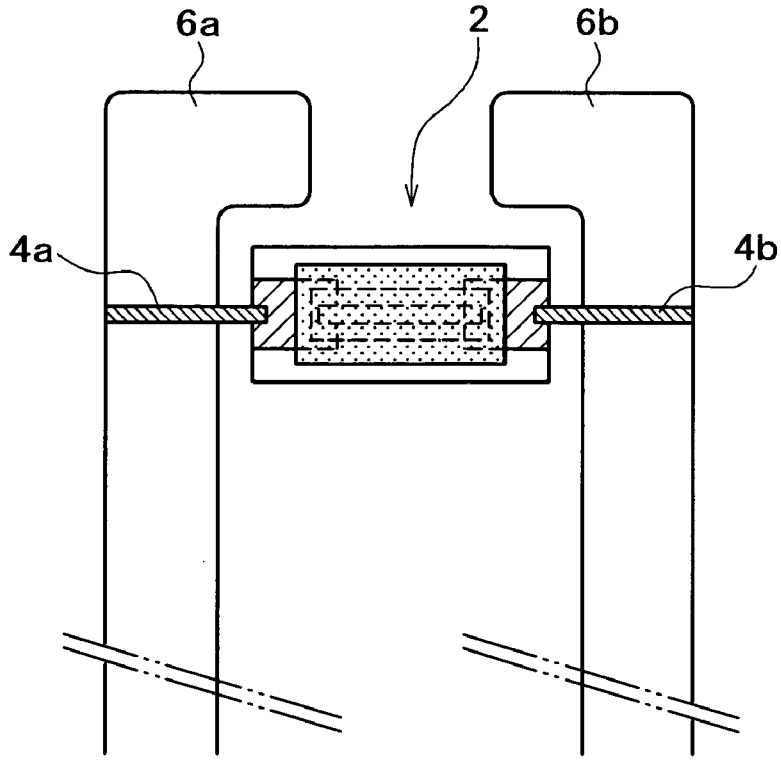
FIG. 1 is a plan view showing principal parts of an overheat protection device according to a first embodiment of the present invention.

FIG. 1 is a plan view showing principal parts of the overheat protection device according to the embodiment. As shown in FIG. 1, in the overheat protection device, a fusible alloy thermal fuse (thermal fuse) 2 is electrically connected with peripheral portions of ends of a pair of long metal spring plates (plate elastic bodies) 6*a* and 6*b* via leads 4*a* and 4*b*, such that the thermal fuse bridges the pair of spring plates.

Figure 2:
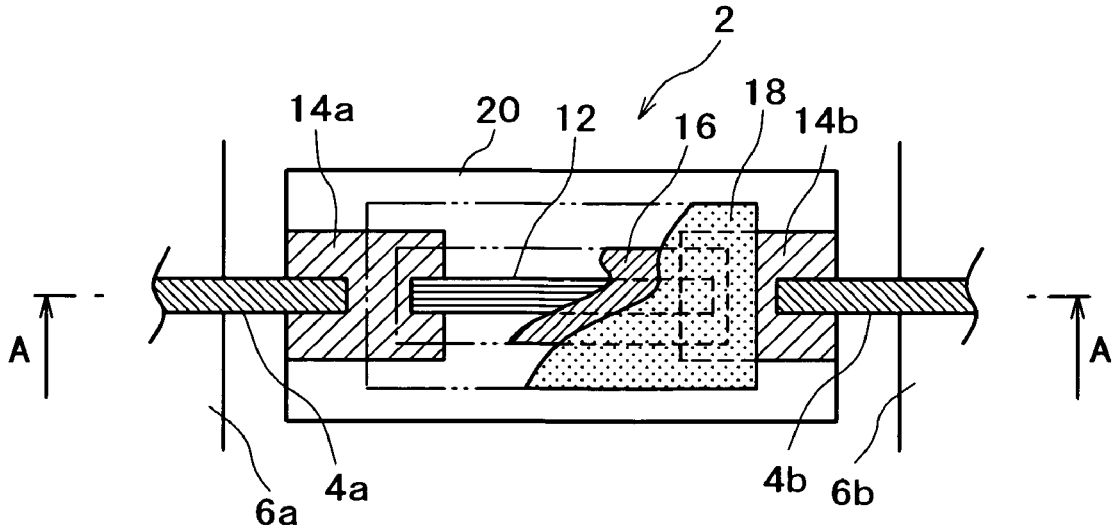
FIG. 2 is an expanded plan view showing the periphery of a fusible alloy thermal fuse in the overheat protection device according to the embodiment.
Figure 3:
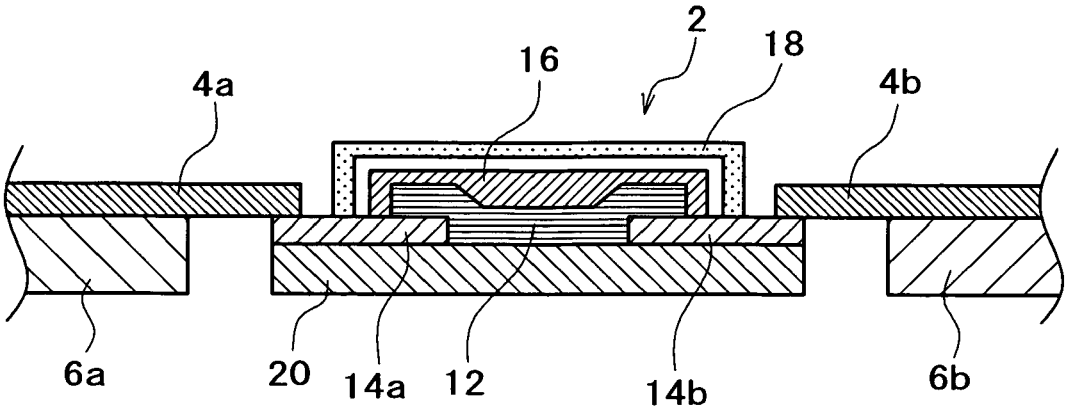
FIG. 3 is a cross-sectional view along a line A—A in FIG. 2.

FIG. 2 is an expanded plan view showing the periphery of the fusible alloy thermal fuse 2 in the overheat protection device according to the embodiment. FIG. 3 is a cross-sectional view along a line A—A in FIG. 2. Note that in FIG. 2, some members are cut, and portions that would exist if not cut, or portions hidden with cut parts are indicated with dot and broken lines.

In FIGS. 2 and 3, numeral 20 denotes a rectangular insulating substrate with a pair of electrodes 14*a* and 14*b* at both ends. A fuse element 12 which melts in correspondence with ambient temperature is integrally connected by welding and the like between the pair of electrodes 14*a* and 14*b* such that the fuse element bridges the both electrodes. The surface of the fuse element 12 is covered with flux 16, the entire flux 16 is covered with an insulating cap 18, and its periphery is fix-sealed with seal resin and the like, thus the fusible alloy thermal fuse 2 is constructed.

The leads 4*a* and 4*b* are soldered to the pair of electrodes 14*a* and 14*b* of the fusible alloy thermal fuse 2, and further, other ends of the leads are respectively connected by welding and the like to the metal spring plates 6*a* and 6*b*.

In the present invention, the material for the insulating substrate 20 is not particularly limited, however, the thermal resistance as a thermal fuse is necessary. From this point, a ceramic material such as alumina is preferable. In this embodiment, the material is a rectangular alumina insulating substrate having a width (up and down directions in FIG. 2) of 1.5 mm, a length (right and left directions in FIG. 2) of 3 mm and a thickness of 0.2 mm. The size of the substrate is extremely small in comparison with that of a conventional general fusible alloy thermal fuse.

In the insulating substrate 20, since a surface opposite to a side where the fuse element 12 and the pair of electrodes 14*a* and 14*b* are formed and arranged is a contact surface pressed into contact with the surface of a movable body as the subject of detection, it is preferable that the contact surface is covered with a thin film for the respective purposes of abrasion resistance, slidability, thermal resistance and the like. An appropriate film may be selected as the thin film in accordance with a purpose, and particularly, a fluororesin film or a polyimide film is preferable. In this embodiment, an adhesive-coated polyimide film with a thickness of 50 μm is provided for improvement in slidability.

Note that the thin film may be provided on the surface opposite to the contact surface. Further, the thin film may be provided on the surfaces of the metal spring plates 6*a* and 6*b* to be described in detail later. In this embodiment, the polyimide film having the thickness of 50 μm is provided in these positions.

As the fuse element 12, any fusible alloy material generally used as an element material of fusible alloy thermal fuse may be used. A material of appropriate composition is selected such that the fuse element melts at a predetermined temperature. As a particular material, a metal alloy of tin, lead and the like may be used. The melting temperature can be controlled by the composition of these metals. In a case where a rotary heating body of a fixing apparatus in an electrophotographic apparatus is the subject of detection, the melting temperature ("predetermined temperature" in the present invention) is selected from the range of 180° C. to 220° C.

As the pair of electrodes 14*a* and 14*b*, metal electrodes generally used as thin-film electrodes may be employed. For example, the electrodes may be formed by coating and calcination of Ag conductive paste such as Ag paste, AgPd paste and AgPt paste. In this embodiment, the pair of electrodes 14*a* and 14*b* are formed by coating and calcinating AgPd paste in a length of 1 mm and a width of 1 mm.

The flux 16 is important for the thermal fuse. The flux is used for ensuring reliability at a high temperature by prevention of re-oxidation of the fuse element, and promoting spheroidizing upon reduction of surface tension of the fuse element, i.e., upon fusion of the fuse element. Generally, the flux types are briefly classified as rosin flux and water soluble flux.

The rosin flux includes R type (Rosin base) flux, RMA type (Mildly Activated Rosin base) flux and RA type (Activated Rosin base) flux having different types of activation. More particularly, the R type flux is a non-active and non-corrosive rosin flux. The RMA type flux is mildly-activated rosin flux which is more appropriate for soldering than the R type flux. The RA type flux is also mildly-activated rosin flux which is further appropriate for soldering than the R type and RMA type flux, but which is highly corrosive. Generally, the R type flux is often used, however, the RMA type flux is often used as flux included in solder paste.

Generally, the water soluble flux has a high content of chlorine which might influence the reliability of semiconductor device. Accordingly, the water soluble flux is inappropriate. However, even in a case where rosin flux is used, various materials are included in a residuum of soldering, and there is a possibility that such materials cause corrosion of the leads and conductive members of print circuit board or reduction of insulation characteristic between conductive members at a high temperature and humidity.

In this embodiment, the R type rosin flux is used as a base.

The insulating cap 18 is used for protection of the fuse element 12. Although the material of the insulating cap is not particularly limited, however, thermal resistance as a thermal fuse is necessary. From this point, it is preferable that the insulating cap is a mold member of alumina ceramic or thermal resistant resin and the like. In the present invention, alumina ceramic is used.

Next, the operation of the fusible alloy thermal fuse 2 will be described with reference to FIGS. 4 and 5.

Figure 4:
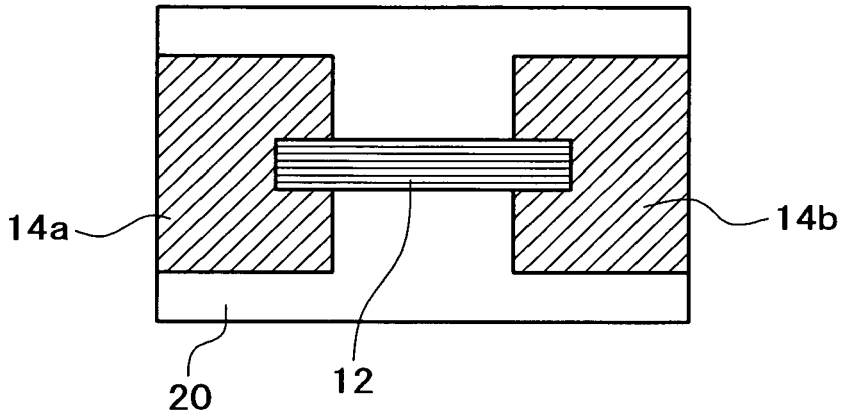
FIG. 4 is a schematic plan view showing principal parts of the fusible alloy thermal fuse before the fuse element melts.

FIG. 4 is a schematic plan view showing principal parts of the fusible alloy thermal fuse 2 before the fuse element 12 melts. The pair of electrodes 14*a* and 14*b* provided on the surface of the insulating substrate 20 are electrically connected (bridged) mutually via the fuse element 12.

During the operation of the thermal fuse, when the temperature of the subject of detection abnormally rises due to some cause and the temperature of the fuse element 12 reaches a predetermined temperature (e.g., 187° C.), the fuse element 12 starts to fuse.

Figure 5:
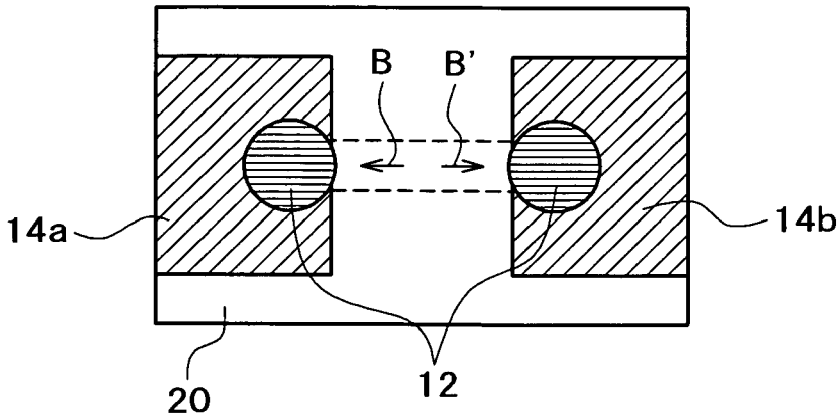
FIG. 5 is a schematic plan view showing the fuse element melted from the state in FIG. 4 to break electrical connection between electrodes.

FIG. 5 is a schematic plan view showing the fuse element 12 melted from the state in FIG. 4 to break electrical connection between the electrodes. As shown in FIG. 5, the fuse element 12 drifts to the both electrodes 14*a* and 14*b* (in arrows B and B' directions) and is spheroidized. Then the fuse element 12 is broken in its intermediate portion, and the electrodes 14*a* and 14*b* are electrically disconnected.

As described above, the fusible alloy thermal fuse 2 having the above construction is electrically connected with the peripheral portions of ends of the pair of metal spring plates 6*a* and 6*b* via the leads 4*a* and 4*b*, such that the thermal fuse bridges the metal spring plates.

The material for the leads 4*a* and 4*b* is not particularly limited, but a general material used as a lead may be employed. For example, the material is selected from copper, nickel, aluminum, stainless steel and the like, and copper and nickel are particularly preferably used. In this embodiment, copper leads are used.

The material for the metal spring plates 6*a* and 6*b* is not particularly limited, and may be selected from various metal materials generally used as a spring plate. More particularly, a spring material such as stainless steel or brass is preferably used. In this embodiment, the metal spring plates 6*a* and 6*b* are formed by etching processing a stainless steel having a thickness of 100 μm.

The metal spring plates 6*a* and 6*b* have a function to provide a deflection reactive force and a function as a conductor to form a break control circuit (not shown).

Note that in the present invention, as a plate elastic bodies as the metal spring plates 6*a* and 6*b* are not necessarily metal members. For example, various elastomers can be used. In this case, as an arrangement for electrical connection with the leads 4*a* and 4*b* (e.g., internal wiring) is required. Accordingly, it is preferable to employ a metal spring plate which can be easily formed and which has excellent conductivity.

Further, in the present invention, the plate elastic bodies must be in pair, however, as only a pair of plate members is required for connection between the thermal fuse and the leads, it may be arranged such that the plate elastic bodies are integrated in the middle portion (i.e., integrated in a portion fixed with a holding member 22 to be described later) on the assumption that electrical short-circuit can be prevented by a well-known unit.

The metal spring plates 6*a* and 6*b* are long and thin film type plates. The pair of metal spring plates 6*a* and 6*b* are provided in mutually parallel to each other. Further, the pair of metal spring plates 6*a* and 6*b* are arranged in so-called flush state such that the both surfaces of the plates are positioned in the same spatial plane.

In the overheat protection device according to this embodiment, the ends of the metal spring plates 6*a* and 6*b* opposite to the ends connected with the fusible alloy thermal fuse 2 are held with an appropriate holding member.

Figure 6:
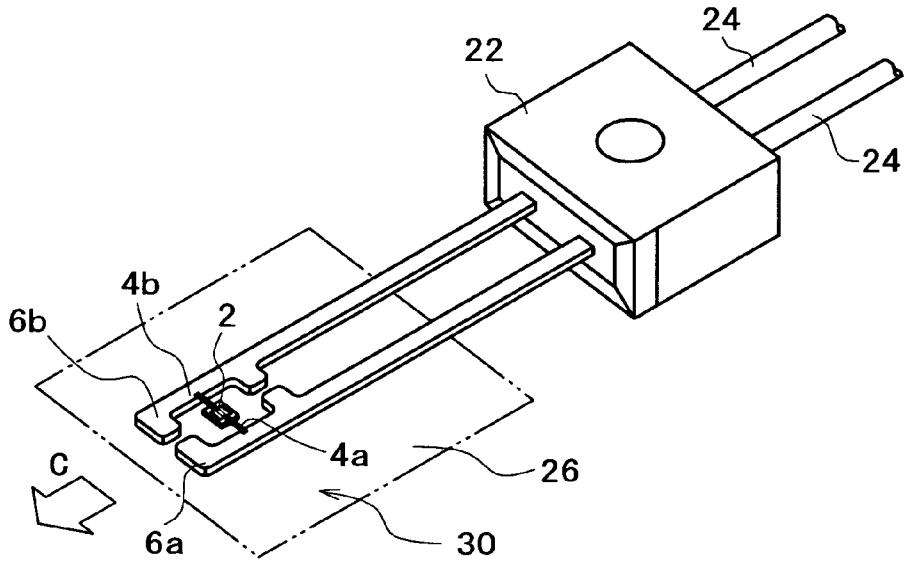
FIG. 6 is a perspective view for explaining the status of use of the overheat protection device in FIG. 1.

FIG. 6 is a perspective view for explaining the status of use of the overheat protection device according to this embodiment. As shown in FIG. 6, in an overheat protection device 30 having the fusible alloy thermal fuse 2, the pair of leads 4*a* and 4*b* and the pair of metal spring plates 6*a* and 6*b*, the ends of the metal spring plates 6*a* and 6*b* opposite to the ends connected with the fusible alloy thermal fuse 2 are fixed with a holding member 22. External leader lines 24 electrically connected with the metal spring plates 6*a* and 6*b* are pulled out from the rear end of the holding member 22, and are connected to a break control circuit (not shown).

In FIG. 6, an area 26 indicated with a two dot-dash line virtually represents the surface of a movable body as the subject of detection. The surface of the movable body moves in an arrow C direction. The overheat protection device 30 is arranged in a direction where the end connected to the fusible alloy thermal fuse 2 is directed to a moving direction (arrow C direction) of the surface of the movable body.

Further, in the overheat protection device 30, a rear surface of the surface, where the pair of electrodes 14*a* and 14*b* are provided, as a contact surface, is pressed into contact with the surface of the movable body by utilizing the deflection reactive force of the metal spring plates 6*a* and 6*b*. That is, the contact surface of the overheat protection device 30 is projected (not shown) to the surface of the metal spring plates 6*a* and 6*b* on the movable body surface (area 26) side, however, the above surface of the metal spring plates 6*a* and 6*b* is not in contact with the surface of the movable body but only the contact surface is pressed into contact with the surface of the movable body.

As described above, in a case where the contact surface of the fusible alloy thermal fuse 2 is covered with a thin film, an appropriate contact load of the fusible alloy thermal fuse 2 to the surface of the movable body (area 26) is within the range of 0.01 N to 0.1 N per contact width of 1 mm.

In the overheat protection device according to this embodiment, as the fusible alloy thermal fuse 2 is provided in the interval between the metal spring plates 6*a* and 6*b* via the leads 4*a* and 4*b* such that the thermal fuse bridges the both electrodes, the fusible alloy thermal fuse 2 itself is not in contact with the metal spring plates 6*a* and 6*b*. Further, as a stable press-contact force to the surface of movable body as the subject of detection can be obtained by utilizing the deflection reactive force of the metal spring plates 6*a* and 6*b*, the surface temperature of the movable body can be directly transmitted to the thermal fuse, thus the thermal capacity is reduced and an excellent thermal response can be attained. Further, as the metal spring plates 6*a* and 6*b* can be formed with a lead frame and the holding member 22 can be formed in the form of lead frame, an overheat protection device having excellent dimensional accuracy can be provided.

Next, a description will be made about a case where the overheat protection device according to this embodiment is applied to a fixing apparatus in an image forming apparatus based on an electrophotographic method.

Figure 7:
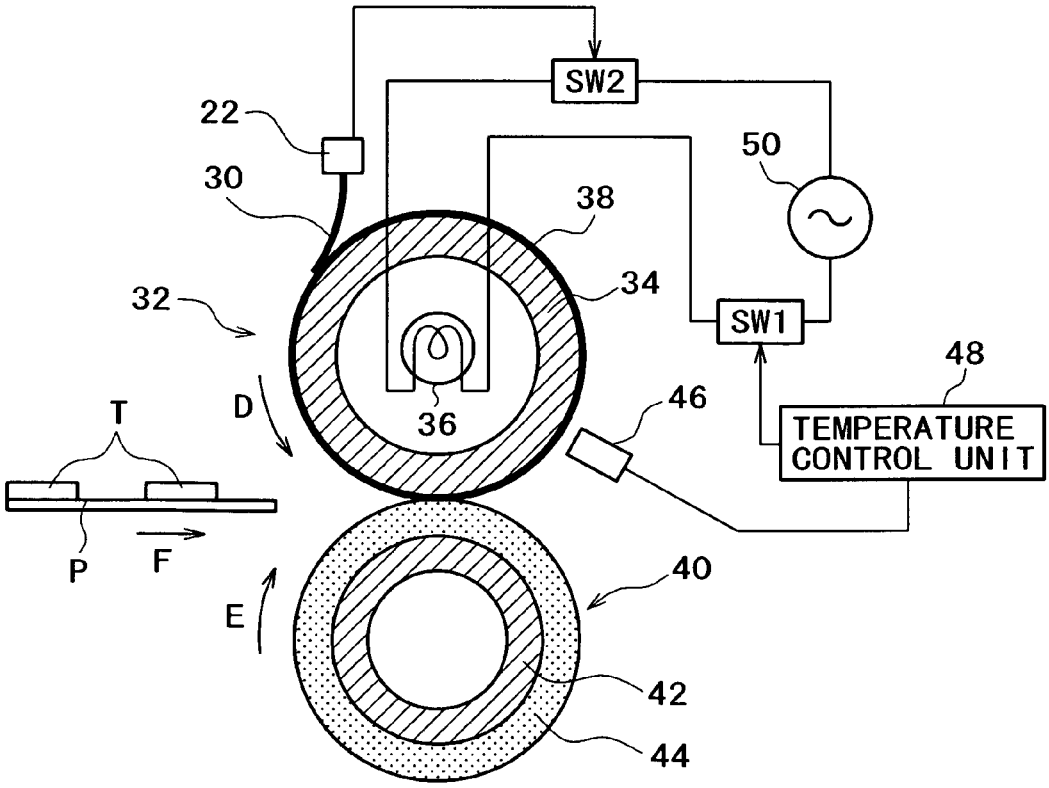
FIG. 7 is a schematic block diagram showing a state where the overheat protection device in FIG. 1 is applied to a heating-roller type fixing apparatus.

In an image forming apparatus such as a copier utilizing electrophotography, an unfixed toner image transferred on the surface of a print sheet is fixed as a permanent image. Generally, a heating roller is utilized in this fixing. FIG. 7 is a schematic block diagram showing a state where the overheat protection device according to this embodiment is applied to a heating-roller type fixing apparatus. As shown in FIG. 7, the fixing apparatus has a heating roller (rotary heating body) 32 and a pressure roller 40.

The heating roller 32 has a metal cylindrical core 34 having a diameter of 25 mm, a heater 36 such as an infrared lamp provided inside the core 34 and a release layer 38 covering the outer periphery of the core 34, as principal elements. The core 34 is formed of aluminum, an aluminum alloy, steel, a steel alloy, copper or a copper alloy and the like. The release layer 38 is provided for preventing toner in an unfixed toner image T formed on the surface of a print sheet P from attaching to the outer periphery of the core 34. As the material for the release layer 38, a thermal resistant material such as fluororesin, HTV (High Temperature Vulcanization) silicone rubber or RTV (Room Temperature Vulcanization) silicone rubber is employed.

Further, a temperature sensor 46 to detect the surface temperature of the heating roller 32 is provided to be opposite to the surface of the heating roller 32. A switch SW1 is opened/closed by a temperature control unit 48 based on the detected temperature, thus a power circuit having the heater 36 and a power unit 50 is ON/OFF controlled. This controls the surface of the heating roller 32 to a predetermined temperature.

On the other hand, the pressure roller 40 is arranged such that its axis is approximately parallel to that of the heating roller 32, for press-contact with the heating roller 32. The pressure roller 40 has a metal cylindrical core 42 and a heat-resisting elastic layer 44 covering the outer periphery of the core 42. The heating roller 32 and the pressure roller 40 are pressed into contact with each other, a nip portion is formed therebetween, and at least one of the rollers is rotate-driven and the other is inverse-driven. Thus the heating roller 32 rotates in an arrow D direction while the pressure roller 40 rotates in an arrow E direction. The print sheet P holding the unfixed toner image T moves in an arrow F direction and is inserted in the nip portion formed between the heating roller 32 and the pressure roller 40 and conveyed. At this time, the toner is fused by heat transmitted from the surface of the heating roller 32, and press-fixed to the surface of the print sheet P by a press-contact force.

In the fixing apparatus with a heating roller having the above arrangement, the thermal efficiency is higher in comparison with other fixing methods and the electric power consumption is saved, and further, fixing can be performed at a high speed. Further, even upon occurrence of paper jam, the temperature of the print sheet P does not exceeds that of the heating roller 32 and the risk of fire is reduced. Accordingly, the heating roller is most widely used at the present time.

In the fixing apparatus having the above construction, it is necessary to raise the surface temperature of the heating roller 32 from a room temperature to a temperature necessary for fixing. For example, in the case of a copier, a copying operation cannot be performed immediately after the power was turned on but a predetermined warm-up time was required. This period is comparatively long. Generally, about 1 to 10 minutes are required as the warm-up time.

A countermeasure generally performed against this problem is to reduce the thermal capacity of the heating roller 32 and to provide a heavy current at the start, which reduce the warm-up time to about 10 to 30 seconds. However, in the case of reduction of warm-up time, as the temperature of the heating roller 32 rapidly rises, the speed of the temperature rise is very rapid, i.e., 5° C. to 15° C./sec.

In the fixing apparatus as described above, there is a possibility that the surface of the heating roller 32 is heated to the abovementioned predetermined temperature or higher temperature due to a malfunction of the temperature control unit 48, break/short-circuit/erroneous positioning of the temperature sensor 46 and the like. In such a case, to avoid damage to peripheral devices at a high temperature or upon occurrence of fire, it is necessary to prevent the temperature rise without an allowable range in the heating roller 32.

Conventionally, an overheat protection device such as a thermostat or a thermal fuse, not in contact with the heating roller 32, is generally connected in series with the heater 36. As the overheat protection device is not in contact with the surface of the heating roller 32 as the subject of detection, the speed of thermal response is limited.

However, if the temperature rise of the heating roller 32 is radical as described above, the operation of the overheat protection device may not be performed accurately due to influence of the response and the like of the device. That is, it is conceivable that even if the temperature of the heating roller 32 is abnormally high, the overheat protection device cannot follow the temperature and the device is actuated when the temperature of the heating roller 32 has already risen to a temperature at which the heating roller 32 itself is damaged.

In this case, to prevent trouble such as a fire in case of overheating, the temperature of the overheat protection device is set to a lower temperature, or the speed of temperature rise is set to a lower speed. However, the warm-up time cannot be sufficiently reduced, or it takes time for reproduction due to a malfunction of the overheat protection device.

On the other hand, the above problems are solved by employing the overheat protection device (further, the overheat protection apparatus) according to this embodiment. First, as shown in FIG. 7, in the overheat protection device 30 fixed with the holding member 22, the rear surface of the surface where the pair of electrodes 14*a* and 14*b* are provided, as a contact surface, is pressed into contact with the surface of the movable body, i.e., the heating roller 32 by utilizing the deflection reactive force of the metal spring plates 6*a* and 6*b*, as described above. When the temperature of the surface of the heating roller 32 becomes equal to or higher than the predetermined temperature, the fuse element 12 in the overheat protection device 30 melts, thereby breaks the electrical connection between the pair of electrodes 14*a* and 14*b*, then the electrical disconnection between the electrodes opens/closes the switch SW2, and a break is caused in the power circuit including the heater 36 and the power unit 50. That is, the overheat protection device 30, the holding member 22 and the switch SW2 construct the overheat protection apparatus according to the present invention.

In this example, as the insulating substrate 20, which is a contact surface of the fusible alloy thermal fuse 2 with the surface of the heating roller 32 is a plane, even in press-contact with the surface of the heating roller 32 which is a rotary and curved-surface body, the contact is not made in plane but line.

Figure 8:
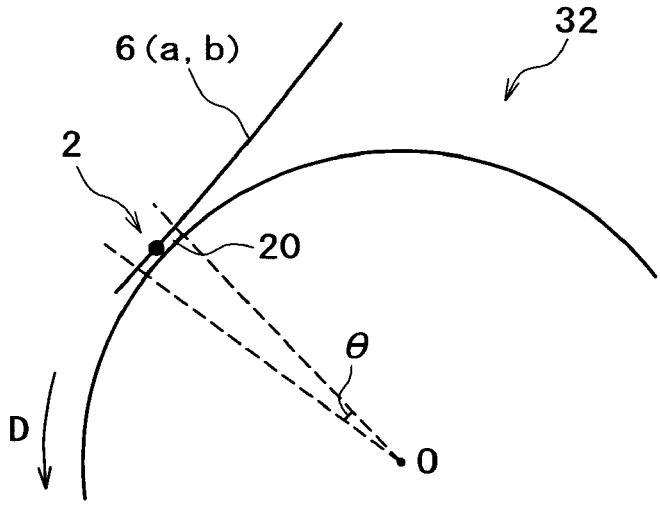
FIG. 8 is a schematic cross-sectional view showing the relation between the heating roller in FIG. 7 and the fusible alloy thermal fuse.

FIG. 8 is a schematic cross-sectional view showing the relation between the heating roller 32 and the fusible alloy thermal fuse 2 according to this embodiment. The contact surface between the surface of the heating roller 32 and the insulating substrate 20 is a line as shown in FIG. 8.

However, if the length of the insulating substrate 20 in the arrow D direction (the rotational direction of the heating roller 32) is sufficiently short, the area of the contact surface is substantially the same as that in the case of line contact. Further, if the fusible alloy thermal fuse 2 is sufficiently small in comparison with the heating roller 32 as the subject of detection, the thermal capacity is small and the thermal response is extremely high. From these points, it is preferable that an angle (central angle) θ formed with two straight lines connecting the both ends of the contact surface of the insulating substrate 20 in the rotational direction of the heating roller 32 with the central point (axis) of the heating roller 32 is equal to or less than 10°.

In this example using the device according to the present embodiment, the central angle θ is set to 6.9°. That is, as the angle is small in comparison with 10° as the upper limit of the preferable range, the delay of thermal response, which is caused because the rotary heating body has a cylindrical shape, hardly occurs. In the case of the conventional thermostat, the central angle θ is about 30° to 70°, and in the case of the conventional thermal fuse, the central angle θ is 15° to 25°. It is understood that the central angle θ of this example is small in comparison with these conventional values and the thermal response is improved.

Figure 9:
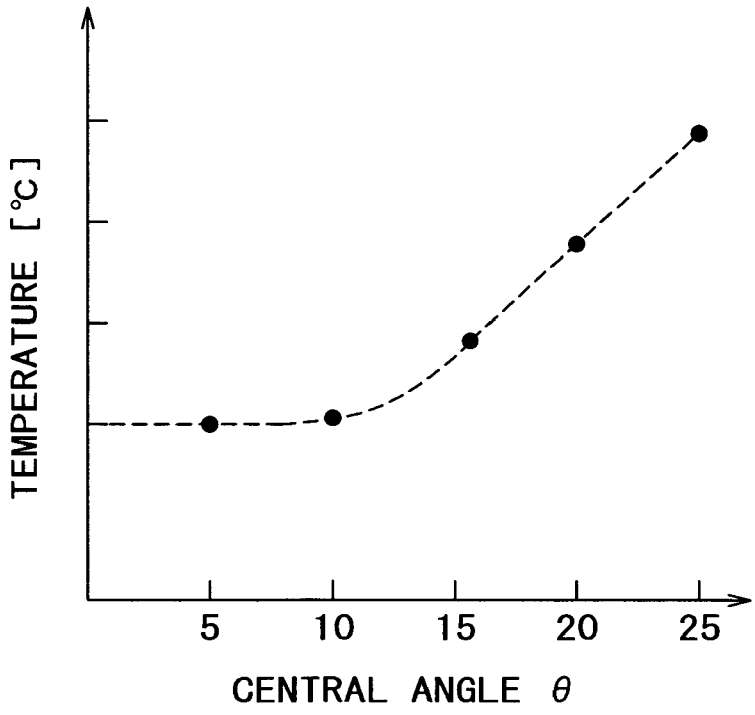
FIG. 9 is a graph showing the relation between a central angle θ and response of the fusible alloy thermal fuse.

Further, an experiment was made to examine the response of the fusible alloy thermal fuse 2 in the apparatus of this example, in a case where the width of the insulating substrate 20 (in up and down directions in FIG. 2) was changed to change the central angle θ. FIG. 9 is a graph showing the relation between the central angle θ and the response of the fusible alloy thermal fuse obtained by the experience. The degree of response is indicated with a temperature at which the fusible alloy thermal fuse melts plotted in a vertical axis in FIG. 9. As it is understood from the graph of FIG. 9, as long as the central angle θ is less than 10°, the response approximately the same as that in a case where the fusible alloy thermal fuse 2 is brought in contact with a plane can be obtained.

It is preferable that the power circuit, including the heater 36 and the power unit 50, and the electric circuit (break control circuit), where the overheat protection device 30 is wired, are independent circuits having different power systems.

Figure 10:
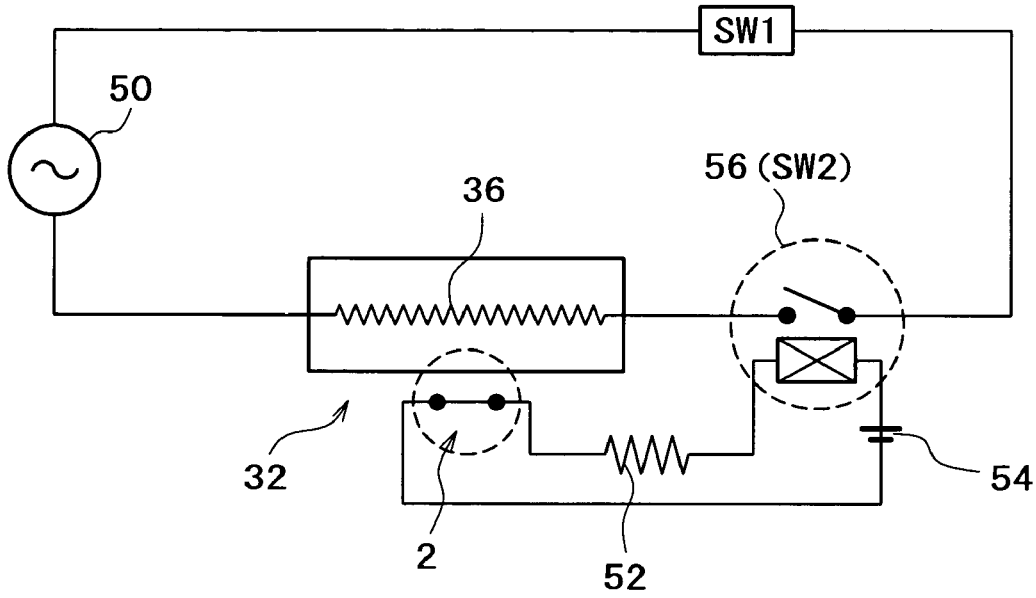
FIG. 10 is a circuit diagram showing a preferable example of a power circuit and a break control circuit in the example of FIG. 7.

FIG. 10 is a circuit diagram showing a preferable example of the power circuit and the break control circuit in this example. As shown in FIG. 10, the electric circuit where the overheat protection device 30 is wired is an independent break control circuit having a different power system from that of the power circuit including the heater (heating device) 36 (and the power unit 50).

Next, the respective circuits will be described.

In the break control circuit, the overheat protection device 30, a low-voltage (e.g., 24 V) direct current power source 54 for driving the thermal fuse, a control terminal of a power relay (relay device) 56, and a correction resistor 52 are connected in series. Note that the correction resistor 52 is provided for adjusting partial pressure to the rated current value of the power relay 56, however, if these values correspond with each other, the correction resistor is not necessary. In the break control circuit, when there is no break in the overheat protection device 30, the circuit is closed and the power relay 56 is operative.

On the other hand, in the power circuit, the heater 36, the power unit 50, the switch SW1 ON/OFF controlled by the temperature control unit 48 in FIG. 7, and an ON/OFF terminal of the power relay 56 are connected in series. In this example, a heating lamp of 1000 W output is used as the heater 36.

In the break control circuit, at normal times where there is no break in the overheat protection device 30, the power relay 56 is actuated with the partial pressure from the direct current power source 54, and the ON/OFF terminal of the power relay 56 is closed, however, upon detection of abnormal temperature exceeding the predetermined temperature, the overheat protection device 30 quickly detects the temperature, then the internal fuse element 12 blows, a partial pressure signal to the power relay 56 is stopped, then the ON/OFF terminal of the power relay 56 becomes opened, thus power supply to the heater 36 is cut.

In the power circuit, a heavy current (high power, i.e., 1000 W in this example) flows, and it is not desirable that the current directly flows through the small fusible alloy thermal fuse 2 in the overheat protection device 30. Accordingly, in this example, the break control circuit independently has a different power system from that of the power circuit, and the current (power) flowing through the break control circuit is suppressed to a value sufficient to actuate the power relay 56 (1500 W in this example) in comparison with the current (power) flowing through the power circuit. As the power circuit and the break control circuit have different power systems, the electric circuit can be appropriately driven with the difference between the current values necessary for the both circuits.

As described above, in the overheat protection device 30, the contact surface is pressed into contact with the surface of the heating roller 32 as the subject of detection by utilizing the deflection reactive force of the metal spring plates 6*a* and 6*b*. As the contact load is 0.2 N and the contact length is 3 mm in this example, the load per 1 mm is 0.065 N (=0.2 N/3 mm).

Further, as described above, in the overheat protection device 30, the surface of the contact surface of the insulating substrate 20 is covered with a polyimide film having a thickness of 50 μm which functions as a slip sheet. Even if the contact surface of the fusible alloy thermal fuse 2 in the insulating substrate 20 slides against the surface of the heating roller 32, the contact surface smoothly slides with the polyimide film, which suppresses damage to the surface of the heating roller 32.

In this device, in a case where power of 1000 W is supplied as heating power source, the warm-up time from a room temperature to the set temperature of 160° C. is about 15 seconds. When abnormal overheating test was performed under this condition without the temperature control unit 48, it was found that the surface temperature of the heating roller 32 when the fusible alloy thermal fuse 2 of the overheat protection device 30 is actuated (the actuation temperature (the predetermined temperature) is 187° C. is 250° C. and there is no thermal damage to the heating roller 32 and its peripheral parts.

On the other hand, when a thermostat which is actuated at 185° C. as a conventional protection device was set in a position away from the heating roller 32 by 0.7 mm, and wiring was made so as to cause a break in a heating power circuit by actuation of the thermostat, it was found that the surface temperature of the heating roller 32 upon actuation of the thermostat is 350° C., and at this time, the heating roller 32 and its peripheral parts cannot be reused due to thermal damage and the parts must be exchanged with new ones (the degree of the thermal damage is within the image forming apparatus).

Figure 11:
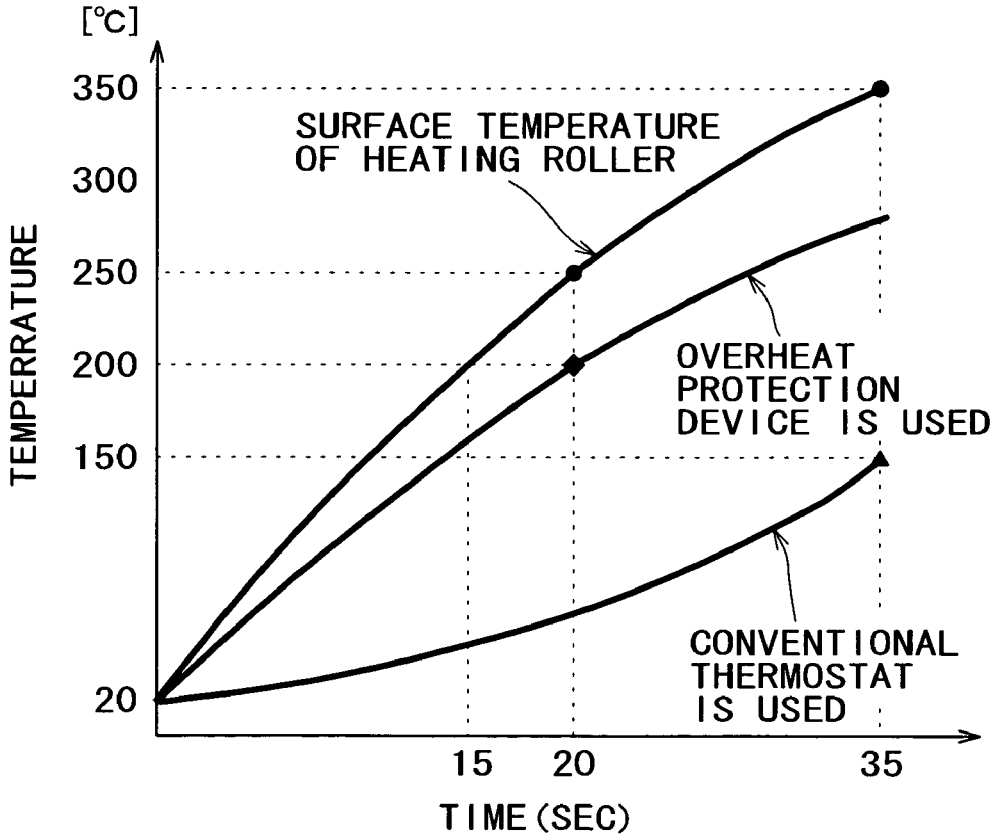
FIG. 11 is a graph showing the result of experiment to examine the difference between thermal response in use of the overheat protection device in FIG. 1 and that in use of a conventional protection device.

FIG. 11 is a graph showing the above-described results.

<Second Embodiment>

Next, a second embodiment will be described as another example of the overheat protection device according to the present invention. In the overheat protection device of this embodiment, a cylindrical type fuse is employed as the thermal fuse.

Figure 12:
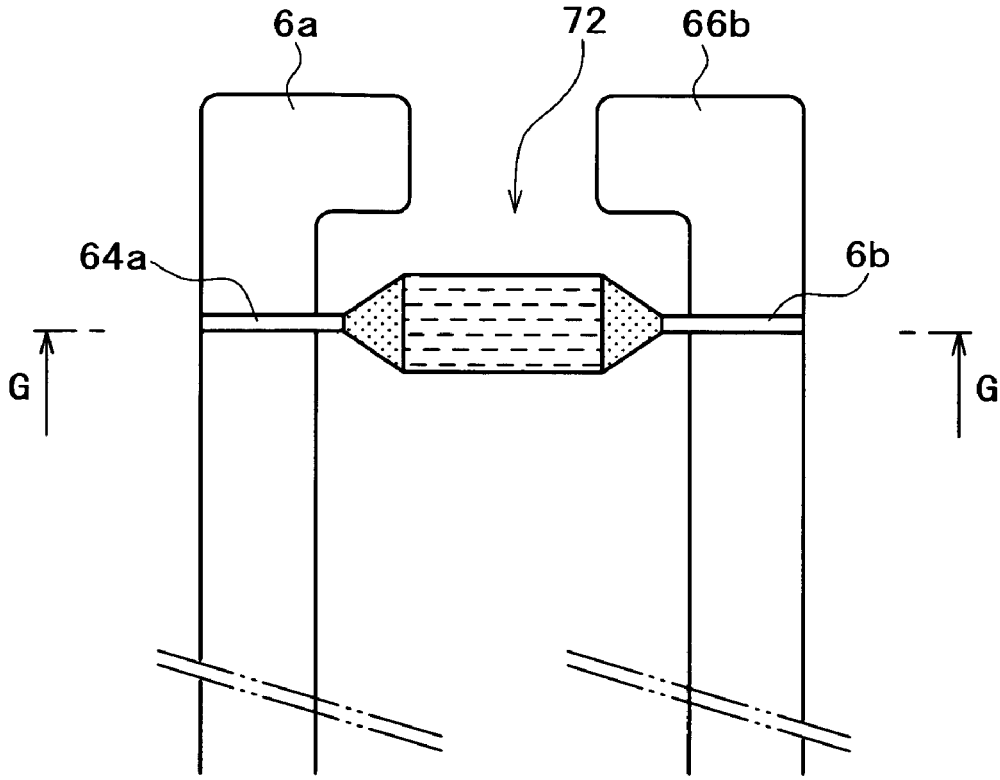
FIG. 12 is a plan view showing principal parts of the overheat protection device according to a second embodiment of the present invention.
Figure 13:
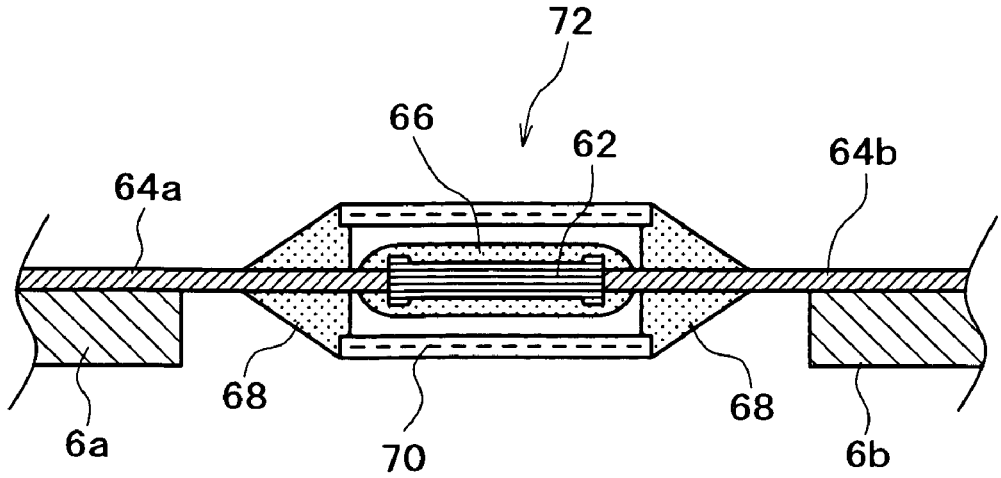
FIG. 13 is a cross-sectional view along a line G—G in FIG. 12.

FIG. 12 is a plan view showing principal parts of the overheat protection device according to this embodiment. FIG. 13 is a cross-sectional view along a line G—G in FIG. 12. As shown in FIGS. 12 and 13, in the overheat protection device according to this embodiment, a fusible alloy thermal fuse (thermal fuse) 72 is electrically connected with peripheral portions of ends of a pair of long metal spring plates (plate elastic bodies) 6*a* and 6*b* via leads (as a pair of electrodes) 64*a* and 64*b*, such that the thermal fuse bridges the pair of spring plates.

In the fusible alloy thermal fuse 72, the pair of leads 64*a* and 64*b* having round ends and cross section are arranged such that the end portions having a function of electrode are opposite to each other. The both ends of a fuse element 62 of low-fusion point alloy, having round ends and cross section, are fixed by welding and the like to the opposed ends of the pair of leads 64*a* and 64*b*, and are covered with flux 66. Further, this is inserted through a cylindrical insulating case 70, and openings at both ends of the insulating case 70 are sealed with insulating seal material 68.

The insulating case 70 is formed of alumina ceramic material and the like, however, the material is not limited to alumina ceramic but appropriate material can be selected as in the case of the insulating cap 18 of the first embodiment. The insulating case 70 has a cylindrical shape in this embodiment, however, in the present invention, any shape may be employed as long as it is a tube shape for the functional sake. In a case where the subject of detection is a rotary heating body, from the point of protection of contact surface with the rotary heating body, the cylindrical shape is desirable.

Since the outer periphery of the insulating case 70 is a contact surface pressed into contact with the surface of the movable body as the subject of detection, it is preferable that the contact surface is covered with a thin film for the respective purposes of abrasion resistance, slidability, thermal resistance and the like. The preferable aspect of the thin film is the same as that of the thin film used in the insulating substrate 20 of the first embodiment. The film may be used on the entire peripheral surface of the insulating case 70 or may be used in an area as the contact surface.

The fuse element 62 is the same as the fuse element 12 of the first embodiment except that the fuse element 62 has round ends and cross section.

In this embodiment, the leads 64*a* and 64*b* also function as electrodes of the fusible alloy thermal fuse 72. For this purpose, the leads have round ends, to which the both ends of the fuse element 62 are fixed by welding and the like. The material of the leads 64*a* and 64*b* is appropriately selected as in the case of the leads 4*a* and 4*b* of the first embodiment.

The preferable aspect and material of the flux 66 is the same as those of the flux 16 of the first embodiment.

The material of the insulating seal material 68 is not particularly limited as long as it is insulating material which can seal the openings at the both ends of the insulating case 70, however, thermal resistance as a thermal fuse is necessary. From this point, epoxy resin, polyimide resin, polyamide imide resin, fluororesin and the like can be given. In this embodiment, epoxy resin is used.

The fusible alloy thermal fuse 72 of this embodiment having the above construction is basically approximate to the fusible alloy thermal fuse 2 of the first embodiment except that the fusible alloy thermal fuse 2 of the first embodiment has a plane structure whereas the fusible alloy thermal fuse 72 of this embodiment has a cylindrical structure. The fusible alloy thermal fuse 72 operates basically in the same manner as that of the operation in the first embodiment described in FIGS. 4 and 5, as a thermal fuse.

Note that the metal spring plates 6*a* and 6*b* have the same structure and function as those described in the first embodiment, therefore, the spring plates have the same reference numerals and the detailed explanation will be omitted.

In the overheat protection device according to this embodiment having the above construction, ends of the metal spring plates 6*a* and 6*b* opposite to the ends connected with the fusible alloy thermal fuse 72 are held with an appropriate holding member. As the construction of the holding member, the fusible alloy thermal fuse 2 and the leads 4*a* and 4*b* in FIG. 6 are replaced with the fusible alloy thermal fuse 72 and the leads 64*a* and 64*b* of this embodiment, accordingly, illustration thereof will be omitted.

In the overheat protection device according to this embodiment, as the fusible alloy thermal fuse 72 is arranged in the interval between the ends of the metal spring plates 6*a* and 6*b* via the leads 64*a* and 64*b* and brides the both electrodes, the fusible alloy thermal fuse 72 itself is not in contact with the metal spring plates 6*a* and 6*b*. Further, as a stable press-contact force to the surface of the movable body as the subject of detection can be obtained by utilizing the deflection reactive force of the metal spring plates 6*a* and 6*b*, the surface temperature of the movable body can be directly transmitted to the thermal fuse, thus the thermal capacity can be reduced and an excellent thermal response can be obtained. Further, as the metal spring plates 6*a* and 6*b* can be constructed with a lead frame and the holding member 22 can be formed in the form of lead frame, an overheat protection device having excellent dimensional accuracy can be provided.

As in the case of the overheat protection device of the first embodiment, the overheat protection device according to this embodiment is applicable to a fixing apparatus in an image forming apparatus of electrophotographic method. As the application is basically the same as in the case of the first embodiment, the explanation thereof will be omitted. Note that as the central angle θ described in FIG. 8 cannot be interpreted in the same manner, the central angle will be briefly described.

Figure 14:
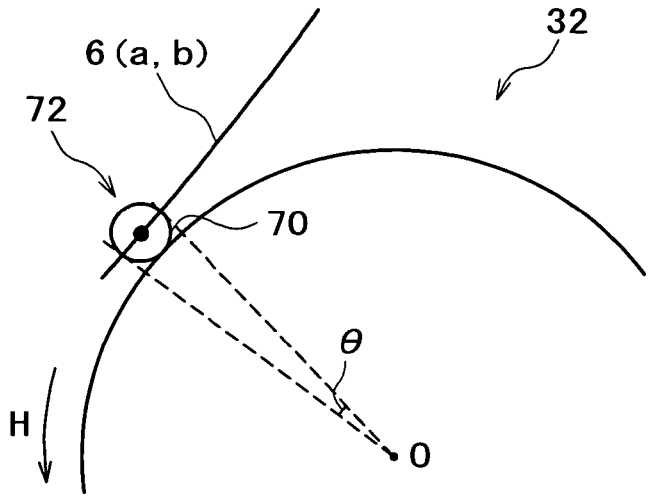
FIG. 14 is a schematic cross-sectional view showing the relation between the heating roller and the fusible alloy thermal fuse in a case where the overheat protection device in FIG. 12 is applied to the fixing apparatus in FIG. 7.

FIG. 14 is a schematic cross-sectional view showing the relation between the heating roller 32 and the fusible alloy thermal fuse 72 in a case where the overheat protection device according to this embodiment is applied to the fixing apparatus described in the first embodiment. The contact surface between the surface of the heating roller 32 and the insulating case 70 is line contact as shown in FIG. 13.

However, if the length of the insulating case 70 in an arrow H direction (the length in the rotational direction of the heating roller 32), i.e., the diameter of the insulating case 70 is sufficiently short, the area of the outer periphery of the insulating case 70 is reduced, and a comparatively large contact area can be obtained even in line contact. Further, if the fusible alloy thermal fuse 72 is sufficiently small in comparison with the heating roller 32 as the subject of detection, the thermal capacity is reduced, and an extremely high thermal response can be obtained. From these points, it is preferable that the angle θ formed with two straight lines connecting the both ends of the insulating case 70 in the rotational direction (arrow H direction) of the heating roller 32 with a central point O of the heating roller 32 is equal to or less than 10°. The other ideas about the central angle θ are as described in the first embodiment.

<Third Embodiment>

Finally, a third embodiment as an example of the temperature control device according to the present invention will be described. The temperature control device according to this embodiment is constructed by use of the overheat protection device of the first embodiment.

Figure 15:
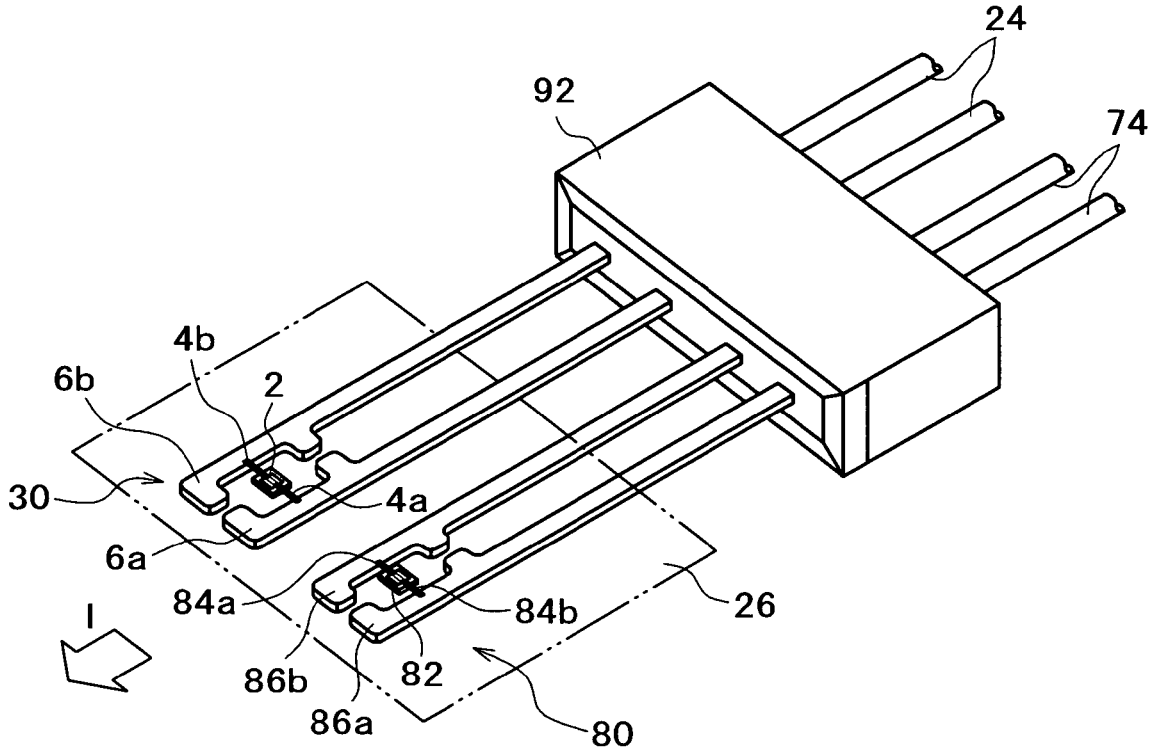
FIG. 15 is a perspective view showing an example of a temperature control device according to the present invention.

FIG. 15 is a perspective view showing the temperature control device according to this embodiment. In FIG. 15, constituent elements and functions the same as those of the overheat protection device of the first embodiment have the same reference numerals as those in FIG. 6 and the detailed explanations thereof will be omitted.

In FIG. 15, in the overheat protection device 30, the ends of the metal spring plates 6*a* and 6*b* opposite to the ends connected with the fusible alloy thermal fuse 2 are held with a holding member 92, and the external leader lines 24 electrically connected with the metal spring plates 6*a* and 6*b* are connected with the break control circuit (not shown), as in the case of the first embodiment.

As a feature of this embodiment, a temperature detection device 80 is further fixed with the holding member 92.

The temperature detection device 80 has a pair of long metal spring plate (plate elastic bodies) 86*a* and 86*b* arranged such that both surfaces are positioned in respectively the same spatial planes, i.e., in so-called flush state, and a temperature sensor 82 electrically bridging portions around the ends of the spring plates via leads 84*a* and 84*b*.

As it is understood from FIG. 15, the temperature detection device 80 has a shape approximate to that of the overheat protection device 30. The metal spring plates 6*a* and 6*b* and the metal spring plates 86*a* and 86*b* are arranged in parallel and in flush state such that the thermal fuse 2 positioned in one end side of the metal spring plates 6*a* and 6*b* and the temperature sensor 82 positioned in one end side of the metal spring plates 86*a* and 86*b* are in approximately corresponding positions (from approximately equal distance from the holding member 92), and the other end sides are fixed with the holding member 92, thereby the both devices (overheat protection device 30 and temperature detection device 80) can be integrated with each other.

Also, in the temperature detection device 80, external leader lines 74 electrically connected with the metal spring plates 86*a* and 86*b* are pulled out from the rear end of the holding member 92, and connected with the temperature control device (not shown) (temperature control unit 48 in FIG. 7).

According to this embodiment, a temperature control device having the function of the overheat protection device 30 of the first embodiment with the excellent characteristic and having the function of the temperature detection device 80 for the temperature control can be provided. As the both devices are integrated, the total space can be reduced.

The temperature sensor 82 is not particularly limited, and a thermal-resistant temperature sensor conventionally used as a heat-sensitive device can be preferably used. A thermister, a thermoelectric couple, a thermopile and the like can be given. In this embodiment, a thin film thermister is used.

Further, the leads 84*a* and 84*b* have basically the same function as that of the leads 4*a* and 4*b*, and the metal spring plates 86*a* and 86*b* have basically the same function as that of the metal spring plates 6*a* and 6*b*. Accordingly, the detailed explanations thereof will be omitted.

Further, as the temperature detection device 80, including the temperature sensor 82, the leads 84*a* and 84*b* and the metal spring plates 86*a* and 86*b*, is a well-known device and a temperature detection device conventionally used by persons skilled in the art of electrophotography can be employed.

Figure 16:
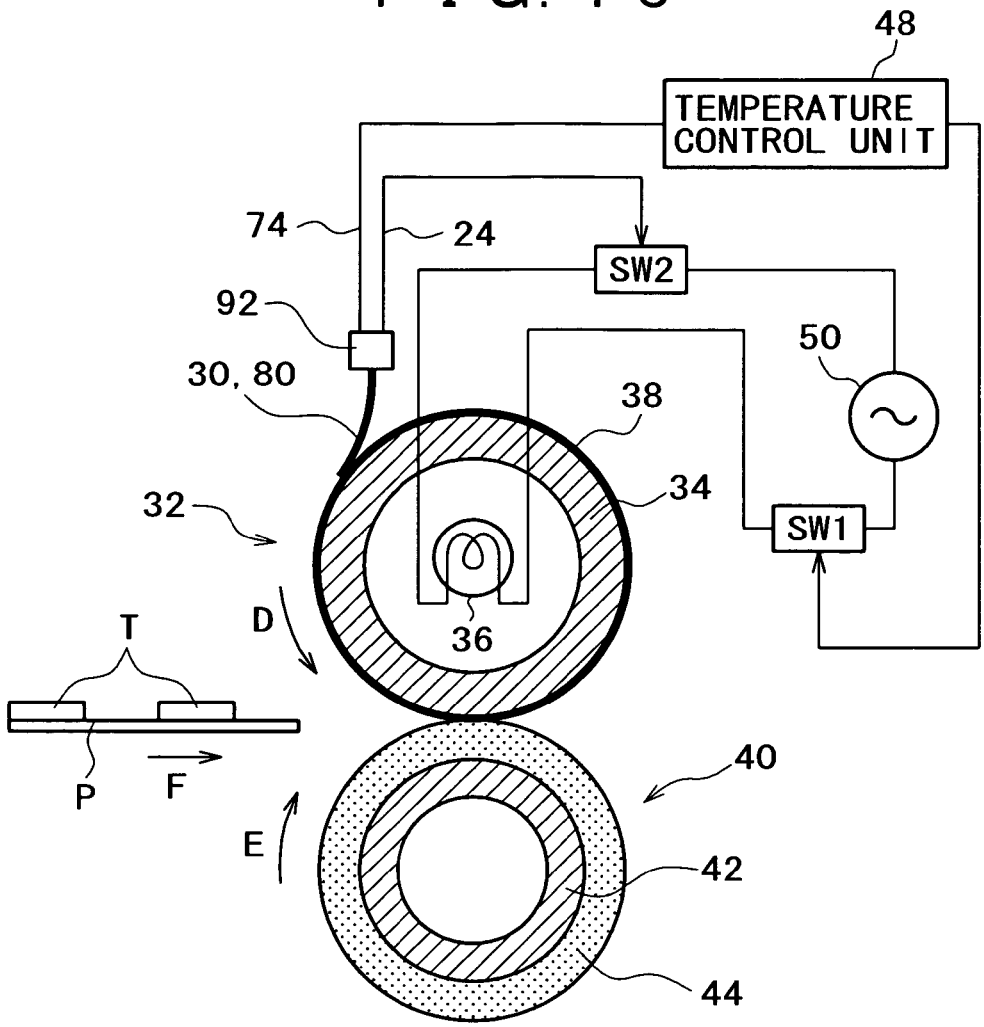
FIG. 16 is a schematic block diagram showing a state where the temperature control device in FIG. 15 is applied to the heating roller-type fixing apparatus.
Figure 17:
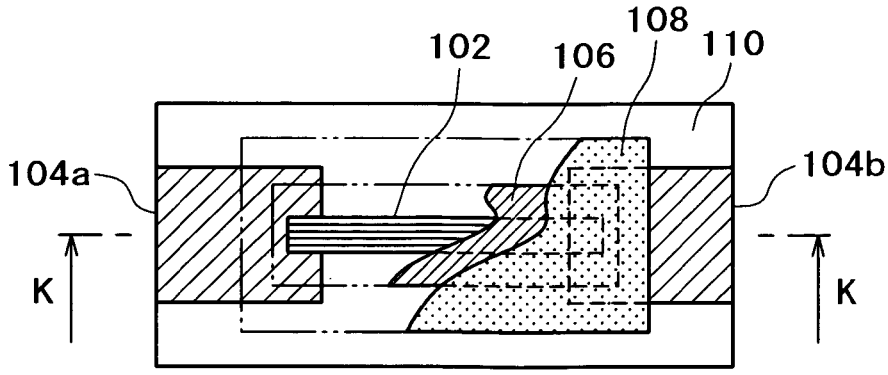
FIG. 17 (RELATED ART)
FIG. 17 is a plan view showing an example of a conventional fusible alloy thermal fuse.
Figure 18:
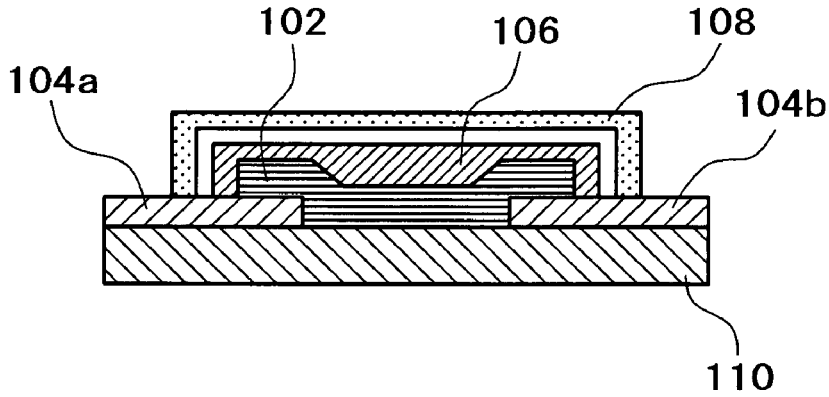
FIG. 18 (RELATED ART)
FIG. 18 is a cross-sectional view along a line K—K in FIG. 17.
Figure 19:
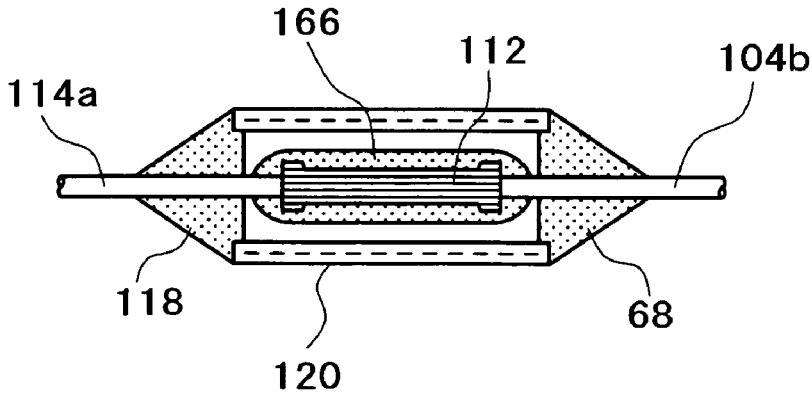
FIG. 19 (RELATED ART)
FIG. 19 is a longitudinal cross-sectional view showing an example of a conventional axial (cylindrical) fusible alloy thermal fuse.

FIG. 16 is a schematic block diagram showing a state where the temperature control device of this embodiment is applied to a heating roller-type fixing apparatus. The fixing apparatus has the same basic construction as that of the fixing apparatus in FIG. 7 where the overheat protection device of the first embodiment is employed. The only difference is that in FIG. 16, the separate overheat protection device 30 and the temperature sensor 46 are replaced with a temperature control device (30, 80, 92) where the above separate devices are integrated, and the circuitry is changed in correspondence with the replacement. Accordingly, in FIG. 16, constituent elements having the same structure and function as those in FIG. 7 have the same reference numerals and the detailed explanations thereof will be omitted.

As shown in FIG. 16, in this example, in the temperature control device (30, 80 and 92) where the overheat protection device 30 and the temperature detection device 80 are integrated, the contact surface of the overheat protection device 30 and the temperature sensor 82 of the temperature detection device 80 are pressed into contact with the surface of the heating roller 32 by utilizing the deflection reactive forces of the metal spring plates 6*a* and 6*b* and the metal spring plates 86*a* and 86*b*. The external leader lines 24 electrically connected with the metal spring plates 6*a* and 6*b* are wired as in the case of FIG. 7.

On the other hand, the external leader lines 74 electrically connected with the metal spring plates 86*a* and 86*b* are connected with the temperature control unit 48, as in the case of the temperature sensor 46 in FIG. 7. The switch SW1 is opened/closed by the temperature control unit 48 based on the detected temperature, thereby the power circuit including the heater 36 and the power unit 50 is ON/OFF controlled. Thus the surface of the heating roller 32 is controlled at the predetermined temperature.

That is, according to the temperature control device (30, 80 and 92) of this embodiment, a temperature control device having the function of the overheat protection device 30 of the first embodiment having the excellent characteristic and the function of the temperature detection device 80 for the temperature control can be provided. As the both devices are integrated with each other, the total space can be reduced. Accordingly, the footprint can be reduced, the assembly steps can be simplified, and the cost can be reduced.

As a preferable aspect in the temperature control device in FIG. 16, it may be arranged such that one common metal spring plate is employed as the metal spring plate 6*a* in the overheat protection device 30 on the temperature detection device 80 side and as the metal spring plate 86*b* in the temperature detection device 80 on the overheat protection device 30 side (i.e., three metal spring plates are used and the central metal spring plate is the common spring plate). As one common metal spring plate is used, further downsizing and simplification of structure can be implemented, and the reduction of space and resources can be improved. In this case, the external leader line electrically connected with the common metal spring plate is wired as the ground for the device.

According to the overheat protection device or the overheat protection apparatus according to the present invention, even if a rapid temperature rise occurs on the surface of the movable body as the subject of detection, as the response to the temperature change is sufficiently quick and the difference between the temperature of the thermal fuse and that of the surface of the movable body can be reduced as much as possible, general accidents due to abnormal temperature rise can be prevented, and thermal damage to the movable body itself can be prevented.

In the overheat protection device according to the present invention, as the thermal fuse can be implemented in a very small size, an excellent thermal response can be obtained. In a conventional instant-start fixing apparatus, when the overheat protection apparatus is actuated, the fixing unit has already sustained thermal damage and then disabled, whereas in the overheat protection device according to the present invention, an abnormal temperature rise can be detected at a temperature equal to or lower than a thermal-resistance temperature of respective members of the fixing apparatus.

Further, in the temperature control device according to the present invention, as the overheat protection device according to the present invention is employed, a temperature control device having a function of the overheat protection device having the excellent characteristic and a function as the temperature detection device for the temperature control can be provided. As the both devices are integrated, the reduction of space, the reduction of the number of parts, the simplification of assembly steps and the reduction of resources can be implemented.

As described above, according to an aspect of the present invention, an overheat protection device for a movable body surface includes a thermal fuse having a fuse element which melts at a predetermined temperature, bridges electrodes in a pair, thereby melts at a temperature equal to or higher than the predetermined temperature to break an electrical connection between the pair of electrodes, and a pair of long elastic bodies, to each of which one of the electrodes is electrically connected at an end or its periphery of the elastic body through a lead. At least one of pairs of upper surfaces and lower surfaces of the elastic bodies are spatially on a same plane.

The pair of electrodes of the thermal fuse may be provided on a surface of an insulating substrate.

A surface, as a contact surface, of the insulating substrate opposite to the surface where the pair of electrodes are provided may be pressed into contact with a surface of a movable body by utilizing a deflection reaction force of the pair of elastic bodies.

The movable body may be a rotary heating body, and the contact surface of the insulating substrate may be pressed into contact with one of an inner peripheral surface and an outer peripheral surface of the rotary heating body.

The contact surface of the insulating substrate may be covered with a thin film. It may be a fluororesin film or a polyimide film.

In the overheat protection device, two straight lines connecting both ends of the contact surface of the insulating substrate being in contact with the rotary heating body with a central point of the rotary heating body may form an angle equal to or less than 10°.

The fuse element may be inserted in an insulating cylindrical body, the pair of electrodes electrically bridged by the fuse element may be provided at both ends of the insulating cylindrical body and integrated with leads. Both ends of the insulating cylindrical body integrated with the leads may be sealed with an insulating seal material, and the leads, in pair, may project outward from the both ends of the insulating cylindrical body.

An outer peripheral surface of the insulating cylindrical body may be pressed into contact with a surface of the movable body by utilizing the deflection reactive force of the pair of elastic bodies.

The movable body may be a rotary heating body, and the outer peripheral surface of the insulating cylindrical body may be pressed into contact with one of the inner peripheral surface and the outer peripheral surface of the insulating cylindrical body.

The outer peripheral surface of the insulating cylindrical body may be coated with a thin film. It may be a fluororesin film and a polyimide film.

Two straight lines connecting both ends of the contact surface of the insulating substrate being in contact with the rotary heating body with a central point of the rotary heating body may form an angle equal to or less than 10°.

The pair of long elastic bodies may be metal spring plates.

According to another aspect of the present invention, an overheat protection apparatus provided in a power circuit in a heating apparatus on a movable body surface includes an overheat protection device having a thermal fuse, a part of which is pressed into contact with the surface of the movable body, which includes a fuse element melting at a predetermined temperature, bridging electrodes in a pair and melting at a temperature equal to or higher than the predetermined temperature to break an electrical connection between the pair of electrodes, thereby causing a break in the power circuit, and a pair of long elastic bodies, to ends or their periphery of which the respective electrodes are electrically connected through leads, at least one of pairs of upper surfaces and lower surfaces of the elastic bodies being spatially on a same plane.

In the overheat protection apparatus, an electric circuit where the overheating prevention device is wired may construct an independent break control circuit having a different power system from that of the power circuit in the heating apparatus.

When the fuse element in the overheating prevention device melts and the electrical connection between the pair of electrodes is broken, a relay device included in the break control circuit may be actuated to cause a break in the power circuit. In the apparatus, an electric current flowing through the break control circuit may be smaller than an electric current flowing through the power circuit. Electric power supplied to the break control circuit may be smaller than electric power supplied to the power circuit.

In the break control circuit, a correction resistor may be connected in series with the overheating prevention device.

According to another aspect of the present invention, a temperature control device for a movable body surface includes an overheat protection device, a temperature detection device and a holding member. The overheat protection device includes a thermal fuse having a fuse element which melts at a predetermined temperature, bridges electrodes in a pair and melts at a temperature equal to or higher than the predetermined temperature to break an electrical connection between the pair of electrodes, and a pair of long elastic bodies, to each of which one of the electrodes is electrically connected at an end or its periphery of the elastic body through a lead, at least one of pairs of upper surfaces and lower surfaces of the elastic bodies being spatially on a same plane. The temperature detection device includes a pair of long elastic bodies, at least one of pairs of upper surfaces and lower surfaces of the elastic bodies being spatially on a same plane, and a temperature sensor electrically bridging portions around ends of the pair of elastic bodies on one side. The holding member holds the overheat protection device and the temperature detection device. A side of the pair of elastic bodies in the overheat protection device not connected with the thermal fuse and a side of the pair of elastic bodies in the temperature detection device not connected with the temperature sensor are fixed to the holding member and the both devices are integrated, such that the pair of plate elastic bodies in the overheating prevention device and the pair of plate elastic bodies in the temperature detection device are in parallel to each other and at least one of pairs of upper surfaces and lower surfaces of the elastic bodies of both devices are spatially on a same plane, and such that the thermal fuse in the overheat protection device and the temperature sensor in the temperature detection device are in positions away from the holding member by approximately equal distances.

The elastic body of the overheat protection device and the elastic body of the temperature detection device adjacent to each other may be integrated as one common elastic body.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2003-435692 filed on Dec. 26, 2003 including specification, claims, drawings and abstract is incorporated herein by reference in its entirety.

What is claimed is:

1. An overheat protection device for a movable body surface, the device comprising:

a thermal fuse, a part of which is pressed into contact with a surface of the movable body, comprising a fuse element which melts at a predetermined temperature; the fuse element bridging electrodes in a pair and melting at a temperature equal to or higher than the predetermined temperature to break an electrical connection between the pair of electrodes; and a pair of long elastic bodies, to each of which one of the electrodes is electrically connected at an end or the periphery of the elastic body through a lead, at least one of pairs of upper surfaces and lower surfaces of the elastic bodies being spatially on a same plane.

2. The overheat protection device for a movable body surface according to claim 1, wherein the pair of electrodes of the thermal fuse is provided on a surface of an insulating substrate.

3. The overheat protection device for a movable body surface according to claim 2, wherein a surface of the insulating substrate opposite to the surface where the pair of electrodes are provided is pressed into contact with a surface of the movable body as a contact surface by utilizing a deflection reaction force of the pair of elastic bodies.

4. The overheat protection device for a movable body surface according to claim 3, wherein the movable body is a rotary heating body, and the contact surface of the insulating substrate is pressed into contact with one of an inner peripheral surface and an outer peripheral surface of the rotary heating body.

5. The overheat protection device for a movable body surface according to claim 3, wherein the contact surface of the insulating substrate is covered with a thin film.

6. The overheat protection device for a movable body surface according to claim 5, wherein the thin film is one of a fluororesin film and a polyimide film.

7. The overheat protection device for a movable body surface according to claim 4, wherein two straight lines connecting both ends of the contact surface of the insulating substrate being in contact with the rotary heating body with a central point of the rotary heating body forms an angle equal to or less than 10°.

8. The overheat protection device for a movable body surface according to claim 1, wherein the fuse element is inserted in an insulating cylindrical body, the pair of electrodes electrically bridged by the fuse element are provided at both ends of the insulating cylindrical body and integrated with leads, both ends of the insulating cylindrical body integrated with the leads are sealed with an insulating seal material, and the leads, in pair, project outward from the both ends of the insulating cylindrical body.

9. The overheat protection device for a movable body surface according to claim 8, wherein an outer peripheral surface of the insulating cylindrical body is pressed into contact with a surface of the movable body by utilizing the deflection reactive force of the pair of elastic bodies.

10. The overheat protection device for a movable body surface according to claim 9, wherein the movable body is a rotary heating body, and the outer peripheral surface of the insulating cylindrical body is pressed into contact with one of the inner peripheral surface and the outer peripheral surface of the insulating cylindrical body.

11. The overheat protection device for a movable body surface according to claim 10, wherein the outer peripheral surface of the insulating cylindrical body is coated with a thin film.

12. The overheat protection device for a movable body surface according to claim 11, wherein the thin film is one of a fluororesin film and a polyimide film.

13. The overheat protection device for a movable body surface according to claim 10, wherein two straight lines connecting both ends of the contact surface of the insulating substrate being in contact with the rotary heating body with a central point of the rotary heating body forms an angle equal to or less than 10°.

14. The overheat protection device for a movable body surface according to claim 1, wherein the pair of long elastic bodies are metal spring plates.

15. An overheat protection apparatus provided in a power circuit in a heating apparatus on a movable body surface, the overheat protection apparatus comprising:

an overheat protection device comprising:

a thermal fuse, a part of which is pressed into contact with the surface of the movable body, comprising a fuse element which melts at a predetermined temperature, the fuse element bridging electrodes in a pair and melting at a temperature equal to or higher than the predetermined temperature to break an electrical connection between the pair of electrodes, thereby causing a break in the power circuit; and a pair of long elastic bodies, to ends or the periphery of which the respective electrodes are electrically connected through leads, at least one of pairs of upper surfaces and lower surfaces of the elastic bodies being spatially on a same plane; and a holding member holding the overheat protection device.

16. The overheat protection apparatus according to claim 15, wherein an electric circuit where the overheat protection device is wired constructs an independent break control circuit having a different power system from that of the power circuit in the heating apparatus.

17. The overheat protection apparatus according to claim 16, wherein when the fuse element in the overheat protection device melts and the electrical connection between the pair of electrodes is broken, a relay device included in the break control circuit is actuated to cause a break in the power circuit.

18. The overheat protection apparatus according to claim 16, wherein an electric current flowing through the break control circuit is smaller than an electric current flowing through the power circuit.

19. The overheat protection apparatus according to claim 16, wherein electric power supplied to the break control circuit is smaller than electric power supplied to the power circuit.

20. The overheat protection apparatus according to claim 16, wherein in the break control circuit, a correction resistor is connected in series with the overheat protection device.

21. The overheat protection apparatus according to claim 15, further comprising a switch.

22. A temperature control device for a movable body surface, the device comprising:

an overheat protection device comprising:

a thermal fuse comprising a fuse element which melts at a predetermined temperature, the fuse element bridging electrodes in a pair and melting at a temperature equal to or higher than the predetermined temperature to break an electrical connection between the pair of electrodes; and a pair of long elastic bodies, to each of which one of the electrodes is electrically connected at an end or the periphery of the elastic body through a lead, at least one of pairs of upper surfaces and lower surfaces of the elastic bodies being spatially on a same plane;

a temperature detection device comprising:

a pair of long elastic bodies, at least one of pairs of upper surfaces and lower surfaces of the elastic bodies being spatially on a same plane; and a temperature sensor electrically bridging portions around ends of the pair of elastic bodies on one side; and a holding member holding the overheat protection device and the temperature detection device, wherein a side of the pair of elastic bodies in the overheat protection device not connected with the thermal fuse and a side of the pair of elastic bodies in the temperature detection device not connected with the temperature sensor are fixed to the holding member and the both devices are integrated, such that the pair of elastic bodies in the overheating prevention device and the pair of elastic bodies in the temperature detection device are in parallel to each other and at least one of pairs of upper surfaces and lower surfaces of the elastic bodies of both devices are spatially on a same plane, and such that the thermal fuse in the overheat protection device and the temperature sensor in the temperature detection device are in positions away from the holding member by approximately equal distances.

* * * * *